United States Patent [19]

Bailey

[11] Patent Number: 4,984,784

[45] Date of Patent: Jan. 15, 1991

[54] APPARATUS FOR EXERCISING AND CONDITIONING A HAND

[76] Inventor: Arthur Bailey, 30730 Duff Rd., Walker, La. 70785

[21] Appl. No.: 491,243

[22] Filed: Mar. 9, 1990

Related U.S. Application Data

[63] Continuation-in-part of Ser. No. 242,876, Sep. 12, 1988, abandoned.

[51] Int. Cl.[5] ..... A63B 37/00; A61H 1/02

[52] U.S. Cl. ..... 272/67; 272/68; 128/26

[58] Field of Search ..... 272/67, 68, 93, 127; 128/26, 57

[56] References Cited

U.S. PATENT DOCUMENTS

| | | | |
|---|---|---|---|
| 980,025 | 12/1910 | Titus | 272/67 |
| 1,412,691 | 4/1922 | Lincoln | 272/68 |
| 4,153,248 | 5/1979 | Holmes et al. | 272/68 |

*Primary Examiner*—Stephen R. Crow
*Attorney, Agent, or Firm*—David L. Ray

[57] ABSTRACT

A three part apparatus for exercising and conditioning the hand of the user including a first metal sphere, a second metal sphere and a pivot ring positioned between, and touching, the first and the second sphere, the pivot ring being generally circular in shape and having a hole in the center thereof for receipt of a portion of each sphere, the pivot ring having two parallel faces which are perpendicular to the central longitudinal axis of the pivot ring and a magnet therein for holding said pivot ring to one of the spheres.

1 Claim, 1 Drawing Sheet

APPARATUS FOR EXERCISING AND CONDITIONING A HAND

CROSS-REFERENCE TO RELATED APPLICATIONS

This application is a continuation-in-part of co-pending U.S. patent application Ser. No. 07/242,876 filed Sept. 12, 1988. now abandoned.

BACKGROUND OF THE INVENTION

1. Field of the Invention

The present apparatus relates to exercising devices utilized in exercising and conditioning the human hand.

2. Description of the Prior Art

Apparatus are known in the prior art for exercising and conditioning the human hand. Exemplary of such devices are the following:

U.S. Pat. No. 4,153,248 discloses a toy monolithic ball structure made of resilient material and consisting of two equal diameter spherical sections connected by a neck portion of reduced diameter. The neck portion is defined by a segment of a surface generated by the revolution of a planar arc about an axis lying in its plane. The axis in the structure coincides with the common axis connecting the center points of the two spheres. The radius of the arc is one eighth of this sphere and one embodiment. The molded ball construction will have an erratic bounce that will provide a greater challenge to those trying to bounce it than an ordinary spherical ball.

U.S. Pat. No. 1,412,691 discloses an exercising apparatus including a pair of hollow balls enclosed within a casing which may be made of any flexible material, preferably thin rubber or leather. A relative still collar encircles the casing and is interposed between the balls, the collar serving to space the balls apart. The apparatus is placed in the palm of the hand and squeezed. One of the balls is squeezed against the palm of the hand by the middle finger, fourth finger, and little finger of the operator and the other ball is squeezed the index finger and the thumb.

In the periodical, POPULAR MECHANICS, dated November, 1983, page 44 is published an article entitled "WELL ROUNDED TREATMENT", a copy of which is located in the United States Patent Office, Class 272-68. This article discloses two stainless steel spheres, each of the spheres being a ball within a ball which are manipulated by arthritis patients in the palms of their hands by placing the two balls together and manipulating the two balls in one hand of the patient.

The concept of hand conditioning with two solid spheres appeared in the Ming Dynasty of China and was universally acknowledged in the medical cicles as a functional medical apparatus to stimulate blood circulation, relax muscles, relax joints and aid in arthritic conditions.

SUMMARY OF THE INVENTION

In accordance with the present invention there is provided a three part hand exercising apparatus including two metal spheres used in conjunction with a circular pivot ring placed between the two spheres. In an alternate embodiment of the invention, three metal spheres may be used in conjunction with two circular pivot rings placed therebetween.

The floating pivot ring is placed between the two spheres and the spheres are articulated or pushed toward each other by the hand of the user. The pivot ring facilitates smooth rotation and articulation of the spheres about the collar and provide useful exercise to the user.

BRIEF DESCRIPTION OF THE DRAWINGS

The invention will be more clearly understood by reference to the drawing in which:

FIG. 1 is a side view of the two spheres having the pivot ring placed there between;

DESCRIPTION OF THE PREFERRED EMBODIMENTS

Figure 1:
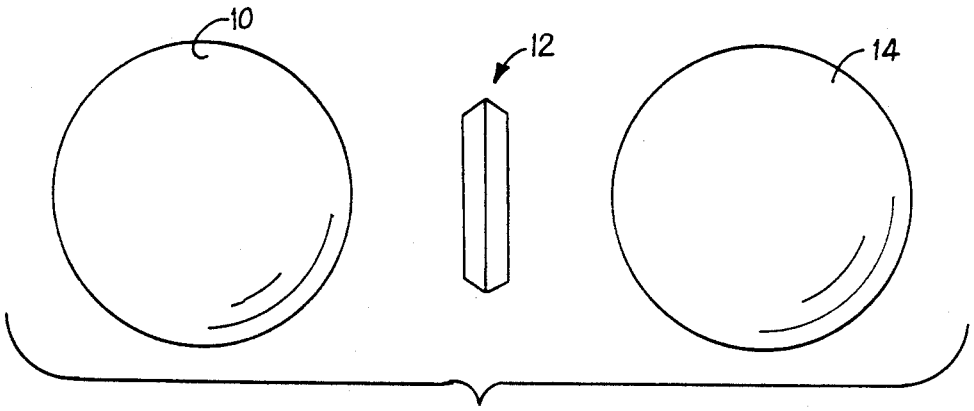

Referring now to the drawings, in FIG. 1 is shown the apparatus of the invention which includes a first sphere 10, a pivot ring generally indicated by the number 12 and a second sphere 14. Second sphere 14 may be larger or smaller than the first sphere 10.

Figure 2:
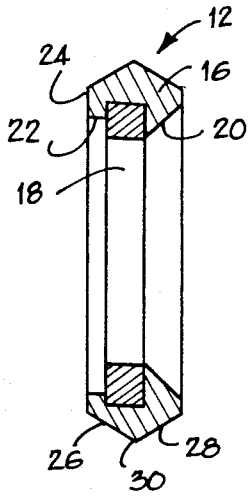
FIG. 2 is a cross-sectional side view of the pivot ring of the invention taken along lines 2—2 of FIG. 3.
Figure 3:
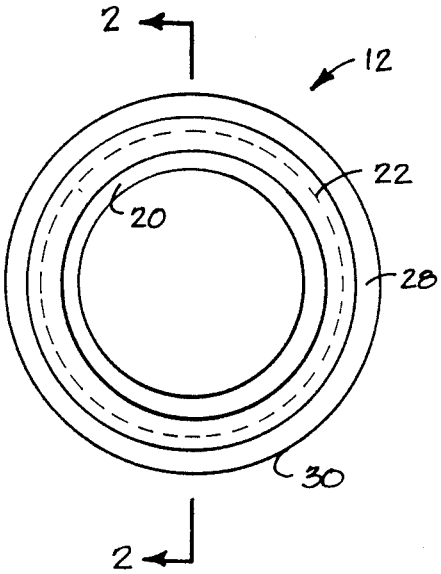
FIG. 3 is a plan view of the pivot ring of the present invention.

In FIGS. 2 and 3 pivot ring 12 can be seen include an outer plastic ring 16 having a hollow cylindrical magnet 18 contained in the center thereof which is of sufficient magnetic strength to cause pivot ring 12 to be held to one of the spheres 10 or 14 by magnetic force. Preferably ring 16 has a beveled portion 20 which is at an approximate 45 degree angle with the center axis of the pivot ring which is utilized to dispense when desired hand cream or ointment onto the spheres after placing ointment in the center portion of the ring.

On the opposite face of pivot ring 16 is a horizontal edge 22 aligned with the center axis of the ring which forms a right angle with the face 24 of the pivot ring and acts as a scraper to remove excess ointment from the sphere. Thus the beveled edge 20 in conjunction with the edge 22 combined to form a system for dispensing ointment onto sphere and scraping excess amount therefrom. Preferably pivot ring 12 has two outer edges 26 and 28 which meet as a point 30 and taper evenly upperwardly thereto.

The pivot ring 12 should have sufficient thickness to insure separation of the spheres and to prevent the spheres from contacting each other as they extend through the sides of pivot ring 12. Furthermore, pivot ring 12 facilitates the interchangeability of various sphere sizes and various weights of spheres, thus insuring a full range of hand articulation or manipulation of the sphere.

The two spheres and collar cooperate as a unit when placed in one hand of the user and sufficient pressure is applied by the hand to maintain contact of the two spheres with the collar therebetween. The apparatus is manipulated or set into motion by moving the fingers toward the thumb and the action is repeated by moving the fingers toward the thumb to exercise and strengthen the hand.

Figure 4:
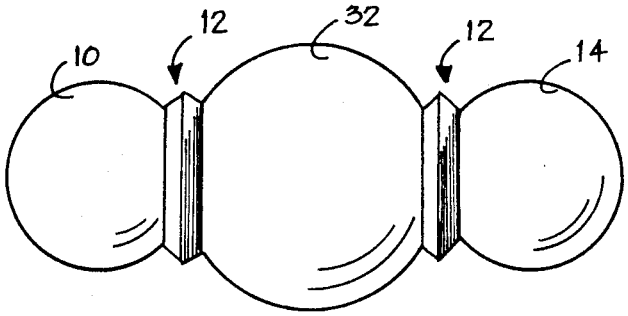
FIG. 4 is a bottom view of the pivot ring of the present invention.

In FIG. 4 is shown an alternate embodiment of the invention in which a third sphere 32 is utilized with two spheres 10 and 14 and two pivot rings 12. Manipulation may be performed with the three spheres which are more complex and challenging to the operator than when using two spheres alone.

Although the preferred embodiments of the present invention have been disclosed and described in detail above, it should be understood that the invention is in no sense limited thereby, and its scope is to be determined by that of the following claims:

What is claimed is:

1. A three part apparatus adapted to be completely held in one hand of the user for exercising and conditioning the hand of the user comprising, in combination:

a. a first metal sphere, b. a second metal sphere, and c. a pivot ring positioned between, and touching, said first and said second spheres, said pivot ring being generally circular in shape and having a hole in the center thereof for receipt of a portion of each of said spheres, said pivot ring having two parallel forces which are perpendicular to the central longitudinal axis of said pivot ring, said pivot ring having a magnet therein which has sufficient magnetic force to hold said pivot ring to said first or said second sphere.

* * * * *